US006015328A

United States Patent [19]

Glaser

[11] Patent Number: 6,015,328

[45] **Date of Patent: *Jan. 18, 2000**

[54] TOOTHBRUSH TOY HAVING INTERCHANGEABLE BENDABLE AND POSABLE CHARACTER HANDLES

[76] Inventor: Robert Glaser, 23800 Commerce Park #D, Cleveland, Ohio 44122-5828

[ * ] Notice: Under 35 U.S.C. 154(b), the term of this patent shall be extended for 245 days.

[21] Appl. No.: 08/533,287

[22] Filed: Sep. 25, 1995

[51] Int. Cl.[7] ..... A46B 9/04

[52] U.S. Cl. ..... 446/72; 446/374; 15/167.1

[58] Field of Search ..... 15/167.1, 105, 15/106; D4/107, 108, 125, 126; D7/656; 403/349; 446/374, 72, 73

[56] References Cited

U.S. PATENT DOCUMENTS

| | | | |
|---|---|---|---|
| D. 71,286 | 10/1926 | Lord . | |
| D. 209,574 | 12/1967 | Zandberg | D4/107 |
| D. 237,659 | 11/1975 | Meyer et al. . | |
| D. 238,127 | 12/1975 | Snyder . | |
| D. 297,784 | 9/1988 | Moret . | |
| D. 347,146 | 5/1994 | Harrison . | |
| D. 347,147 | 5/1994 | Harrison . | |
| D. 347,148 | 5/1994 | Harrison . | |
| 3,181,189 | 5/1965 | Leyden . | |
| 3,400,417 | 9/1968 | Moret . | |
| 4,227,276 | 10/1980 | Ginsburg et al. | 15/167.1 X |
| 4,961,717 | 10/1990 | Hickey | 446/76 |
| 5,306,019 | 4/1994 | Guest et al. | 403/349 X |
| 5,328,370 | 7/1994 | Chen . | |
| 5,353,464 | 10/1994 | Atkins et al. . | |
| 5,361,446 | 11/1994 | Rufo . | |
| 5,369,835 | 12/1994 | Clarke | 15/167.1 |
| 5,444,889 | 8/1995 | Barre | 15/167.1 |

FOREIGN PATENT DOCUMENTS

| | | | |
|---|---|---|---|
| 656087 | 8/1951 | United Kingdom | 446/374 |

*Primary Examiner*—Robert A. Hafer
*Assistant Examiner*—Jeffrey D. Carlson
*Attorney, Agent, or Firm*—Young & Thompson

[57] ABSTRACT

A bendable and posable toothbrush toy has a toothbrush portion detectably secured to a handle portion in the form of an animate character. At least part of the character handle is posable, preferably the arms thereof, by providing a wire insert within the resilient material from which the character handle is molded. The toothbrush can therefore be changed to a variety of different poses, and different character handles can be interchanged. The toothbrush proper secures to the interchangeable handle by a twist-and-lock mechanism which allows young users to simply and detectably fasten the toothbrush portion to the handle portion at a precise relative angular orientation.

5 Claims, 6 Drawing Sheets

TOOTHBRUSH TOY HAVING INTERCHANGEABLE BENDABLE AND POSABLE CHARACTER HANDLES

BACKGROUND OF THE INVENTION

1. Field of the Invention

The present invention relates to toothbrush toys, and more particularly to a toothbrush toy having removable interchangeable character handles which are at least partially bendable and posable.

2. Description of the Related Art

Toy toothbrush with animate handles are well known in the art. A number of design patents show various designs for toothbrushes with animate handle portions. Examples of these are U.S. design patents U.S. Pat. Nos. Des. 71,286, Des. 237,659, Des. 238,127, Des. 297,784, Des. 347,146, Des. 347,147 and Des. 347,148. Providing an animate handle portion on a toothbrush will likely increase its appeal especially to children, and thereby increase the likelihood that the toothbrush will be used regularly, toward achieving better dental hygiene.

In the case of the above designs, however, it appears that the animate handle portion is not removable from the toothbrush, or interchangeable with other animate handle portions, and therefore the appeal of such designs is necessarily limited.

U.S. Pat. No. 5,353,464 in the name of Atkins et al. addresses this situation, by providing a toothbrush with a series of interchangeable animal handles. The handles may thus be periodically interchanged to increase the amusement value of the toothbrush, and, because the handles may be separated from the toothbrush proper, the handles themselves may be played with independently as toys. Significantly, however, the animal handles of this patent appear to be rigid in nature.

Moreover, in the Atkins et al. patent it appears that the toothbrush proper fits into the handle by a frictional sliding arrangement. Thus, in this patent, there remains the possibility that the toothbrush could be fitted into the handle at varying angular orientations, thereby providing an inconsistent gripping surface on the handle, when the toothbrush is used.

Apart from toothbrush with animate handles, it is also known to provide a toothbrush which is removable from its handle. Examples of such toothbrushes from the U.S. patent literature are U.S. Pat. No. 5,361,446, Des. 297,784, U.S. Pat. Nos. 3,400,417and 3,181,189, 5,328,370 is also of interest, for its teaching of a dental tool with a removable handle, which employs a twist-and-lock arrangement. In particular, in this patent, protrusions 14 formed on the stops 12, serve to position the tool at a predetermined angle of orientation relative to the handle.

SUMMARY OF THE INVENTION

The present invention improves upon the above prior art by providing toothbrush toys having interchangeable character handles, in which not only the play value but also the functionality of the toothbrush is improved relative to the prior art.

In the present invention, a toothbrush is removably mounted on a character handle, preferably by a "twist-and-lock" mechanism, such that any given handle may be removed and replaced with a different character handle, thereby to completely change the appearance of the toothbrush, while keeping the same toothbrush proper.

According to a significant feature of the invention, the character handles are bendable in at least selected regions, as well as posable. Preferably, the character handle will be an upstanding humanoid or animal form, whose arms will be posable. Thus, each character handle may itself assume a variety of different poses.

The character handle is preferably molded of plastic material such as PVC (polyvinyl chloride). The arms of the character are relatively thinner than its trunk portion, and therefore more easily deformable. So that the arms may be maintained in a changed posture, a wire is preferably provided internally of the character handle, running for most of the length of the arms. Thus, in the present specification, "bendable" means that the resilient nature of at least parts of the character handle allow the handle to be bent, although the handle once bent will return to its original pose absent some means to keep it in a different pose to which it is bent. "Posable", on the other hand, refers to the bending of the handle to a new pose which is thereafter maintained by the handle, owing to the provision of means for maintaining the new pose, as will be discussed hereinbelow.

The animate character handle used for the toothbrush according to the invention will therefore have significantly enhanced play value, regardless of whether the toothbrush proper is attached to the handle, relative to the animate handles of prior art toothbrushes of this type. Moreover, when the toothbrush proper is attached to the animate handle, the toothbrush according to the invention will have significantly greater functionality than prior art toothbrushes with animate character handles. In particular, the posability of at least the arms of the character handle will allow the toothbrush to be placed on a flat surface in a variety of orientations. For example, the toothbrush could be placed down with the character standing upright, and the arms thus arbitrarily positioned. Alternatively, the same toothbrush could be manipulated such that the arms extend forwardly of the character, whereafter the toothbrush could be placed on a flat surface with the toothbrush proper extending at an angle, and the character handle then being in the posture of doing push-ups.

Additionally, when the animate character handle has bendable and posable arms, the arms could be wrapped around a tube of toothpaste and thus by virtue of the construction according to the present invention, the toothbrush toy with bendable character handle can serve the unique dual function of not only a toothbrush handle, but also a toothpaste tube holder.

Still further, when a child uses the toothbrush according to the invention, the character arms can be wrapped around the child's hand, so that the child not only holds the toothbrush by the character handle, but the character handle also holds the child's hand, thereby to create an enhanced sense of fun and security.

In the toothbrush according to the invention, the toothbrush proper is preferably mounted by a "twist-and-lock" mechanism, whereby the toothbrush proper can be easily mounted in the character handle at a precisely predetermined angular orientation, and thereafter easily detached and re-attached to a different character handle. According to a preferred embodiment of the invention, the female part of this twist-and-lock mechanism provided in the character handle is formed as a separate insert. This allows the female part of the coupling to be more precisely machined and formed of relatively more rigid plastic material than the character handle. Correspondingly, the character handle can be more easily and cheaply molded from relatively softer plastic material.

BRIEF DESCRIPTION OF THE DRAWINGS

Other features and advantages of the present invention will become more apparent from a reading of the following detailed description of several preferred embodiments, which is given with reference to the accompanying drawings, in which.

DETAILED DESCRIPTION OF PREFERRED EMBODIMENTS

Figure 1:
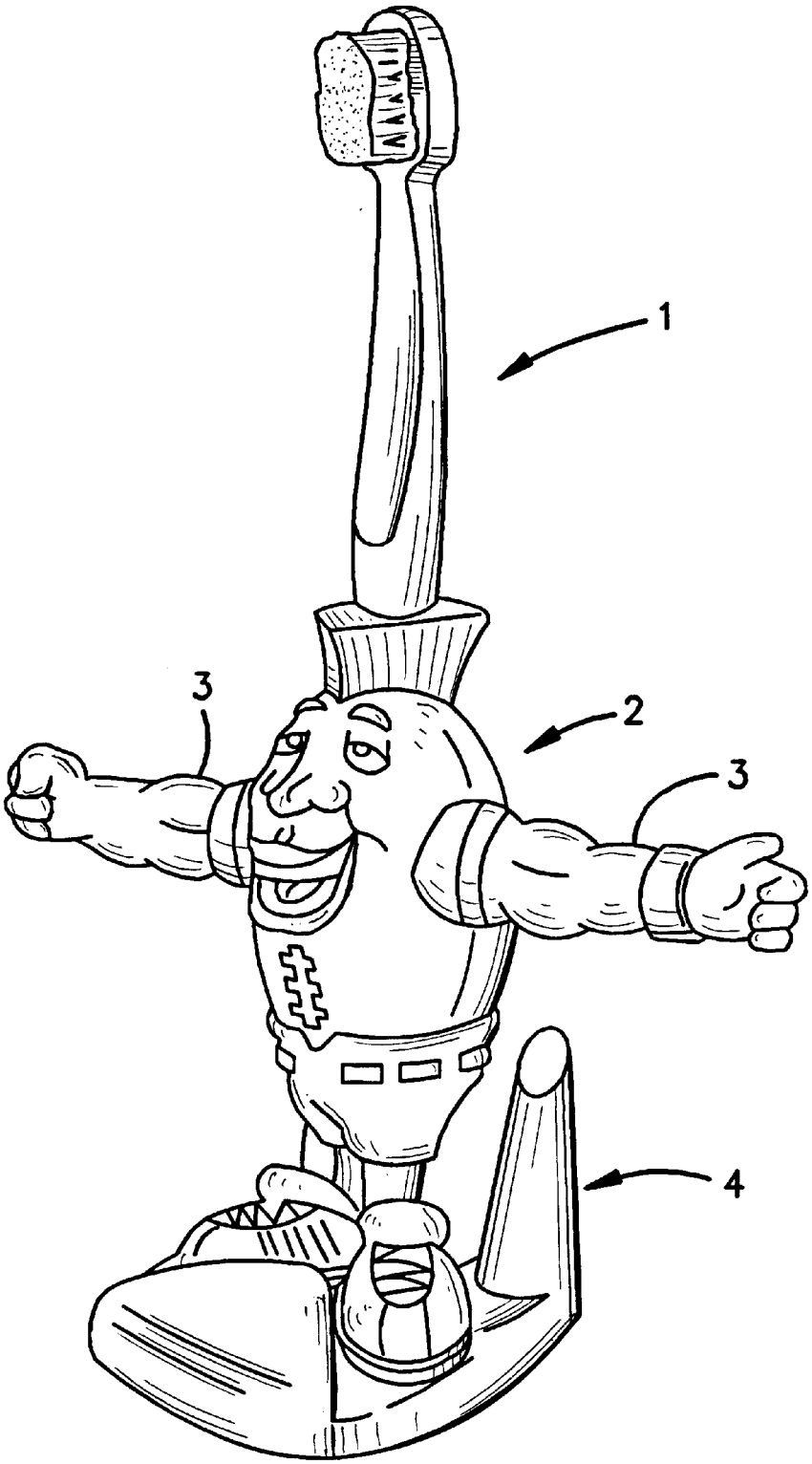
FIG. 1 is a perspective view of a toothbrush toy according to the invention.

FIG. 1 shows a toothbrush toy according to a first embodiment of the invention. As shown therein, the toothbrush comprises a toothbrush portion 1, sometimes referred to herein as the "toothbrush proper", detachably secured to an animate character handle 2. The toothbrush is free-standing in the upright position as shown, with only the components 1 and 2. However, it may be desirable to include a base 4 for receiving the toothbrush, so that the toothbrush is less prone to tipping over. In this embodiment, because the character handle 2 is fashioned as a fanciful football player, the base 4 is formed in the shape of a football tee.

In the toothbrush of FIG. 1, the arms 3 of the character are outstretched, in a plane generally perpendicular to the longitudinal axis of the toothbrush portion 1. It is expressly to be noted, however, that the posture assumed by the handle portion 2 in FIG. 1 is but one of an infinite variety of postures that may be selectively given to the handle, owing to the posable nature of at least the arms 3, which will be described in greater detail below.

Figure 2:
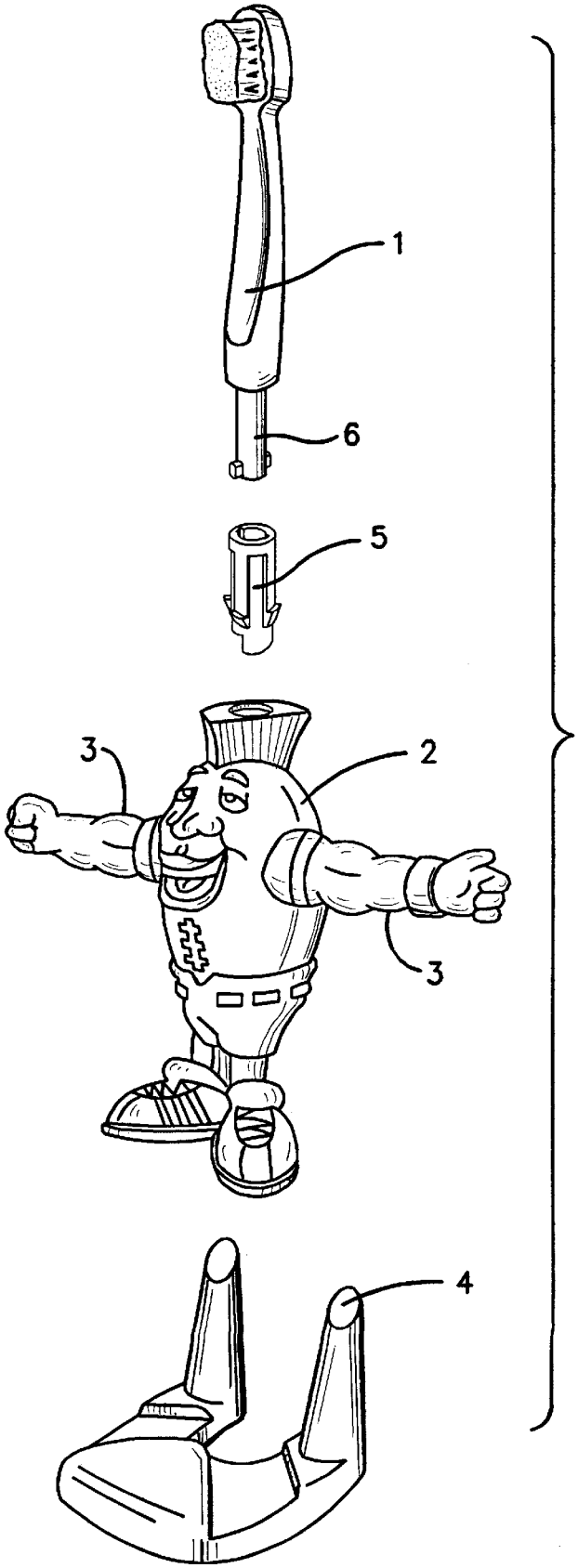
FIG. 2 is an exploded view of the toothbrush toy of FIG. 1, showing the principal components thereof.

FIG. 2 is an exploded view of the toothbrush of FIG. 1. As can be seen in this figure, the toothbrush portion 1 is preferably secured to the animate handle 2 by a twist-and-lock (or bayonet) fastening system, comprising a male part 6 preferably formed integrally with the toothbrush portion 1, and a preferably separate female insert 5 mounted in the handle 2.

Figure 3A:
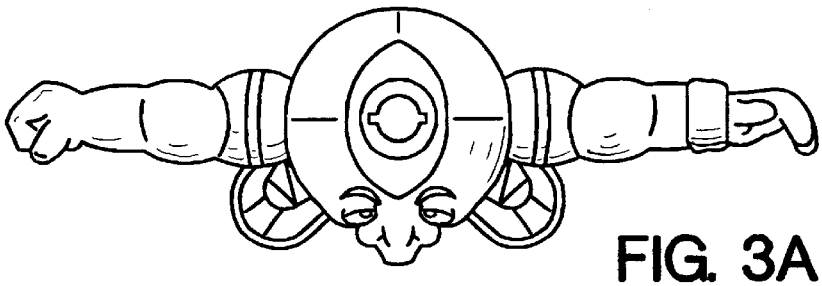
FIGS. 3*a*–3*d* are top, front, side and rear views, respectively, of the animate character handle of the toothbrush of FIG. 1, with FIG. 3*d* being partly in section to show important internal components of the character handle.
Figure 3B:
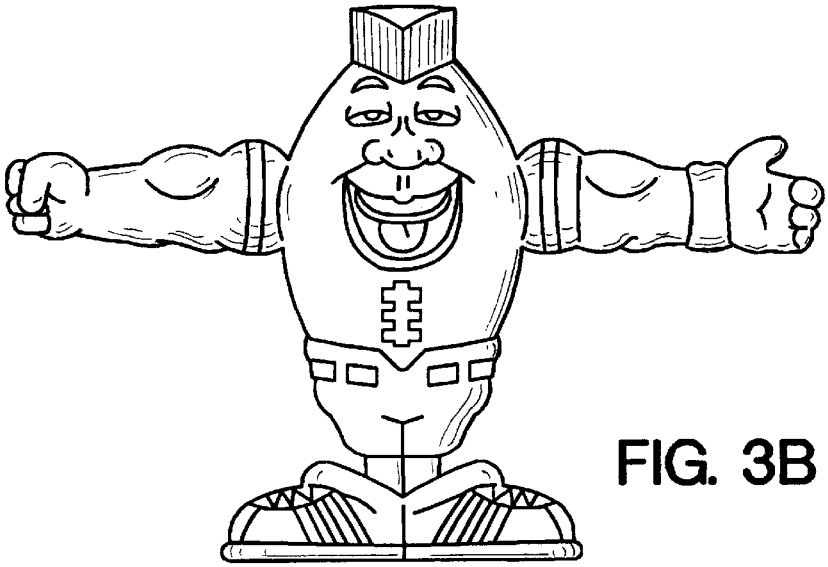
Figure 3C:
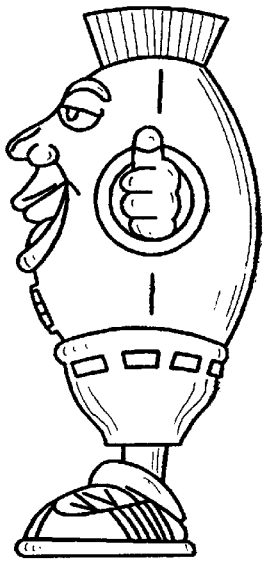

FIGS. 3*a*–3*d* show the animate handle of the FIG. 1 embodiment from various points of view, from which its play value even independent of the toothbrush portion 1 is readily apparent. In FIG. 3*a*, it can be seen that the female insert 5 of the twist-and-lock coupling is mounted in the "head" of the character handle, preferably flush or slightly recessed relative to the head.

Figure 3D:
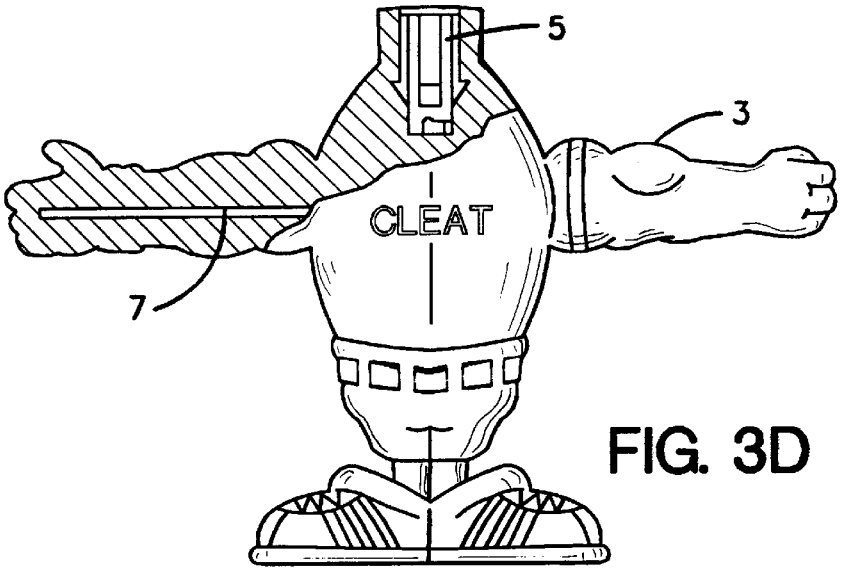

FIG. 3*d* illustrates in its sectional view an important feature of the invention, namely the provision of a wire 7 extending the length of the arms of the character handle, to render the arms bendable. That is, the plastic (e.g. PVC) or rubber material from which the handle is formed is an inherently resilient material; however, the provision of at least one wire allows the handle to stay in the changed positions to which its arms are bent. The character handle 2 of this embodiment is generally symmetrical about a vertical bisecting plane, and so it will be appreciated that wire 7 extends into the other arm 3 about the same distance. It should be noted that the wire in its initial, straight position preferably extends generally perpendicular to the longitudinal axis of the toothbrush, with the character arms correspondingly outstretched, as this has been found to renders the arms significantly more flexible relative to the body than if the wire were arranged at an oblique angle relative to the axis of the toothbrush part.

The character handle of the present toothbrush is also distinct from known posable toys not associated with a toothbrush. In particular, such known toys conventionally have at least a cruciform internal wire structure, so that the character may also be posed in its trunk region. According to the invention, however, it is preferred that the character handle be provided with wire insert only in the arm regions, such that it is free of wire inserts extending generally parallel to the longitudinal axis of the toothbrush portion 1. Thus, the trunk portion of the character handle will generally be thicker and therefore somewhat more rigid that the outstretched arm portions. The character handle is nevertheless bendable in its trunk region, but, owing to the absence of longitudinal wire, not posable in this region.

Figure 4A:
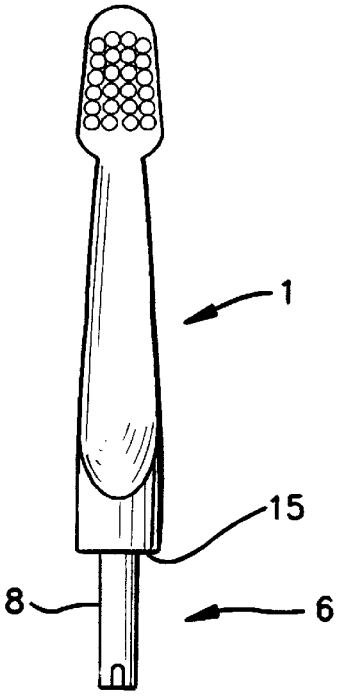
FIGS. 4*a*–4*c* are front, bottom and side views, respectively, of the toothbrush proper removed from the character handle.
Figure 4B:
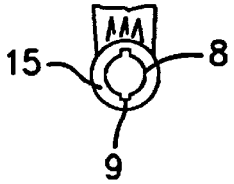
Figure 4C:
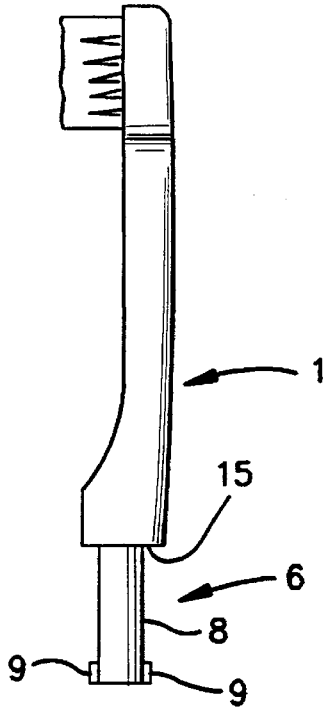

FIGS. 4*a*–4*c* show the toothbrush portion 1 of this embodiment, from several points of view. The toothbrush portion 1 is generally conventional, and made of plastic material sufficiently hard to withstand the rigors of brushing. The toothbrush portion 1 differs from conventional designs in the provision at its base of the male component 6 of the twist-and-lock coupling. In particular, this male part comprises a shank 8 whose diameter is less than the thickness of the main shank of toothbrush portion 1. At the bottom of shank 8, a pair of radially outwardly projecting lugs 9 are formed.

Figure 5A:
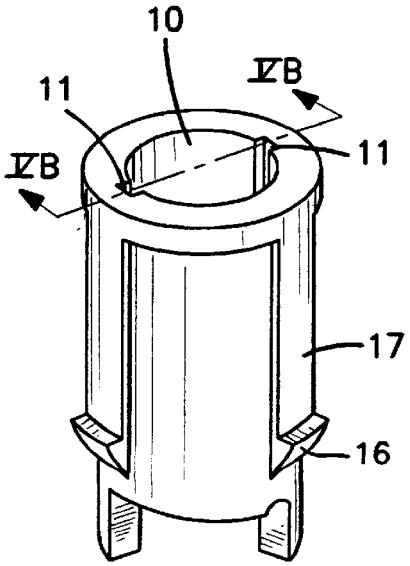
FIGS. 5*a* and 5*b* are top and bottom perspective view, respectively, of the female locking portion insert positioned in the head of the character handle.
Figure 5B:
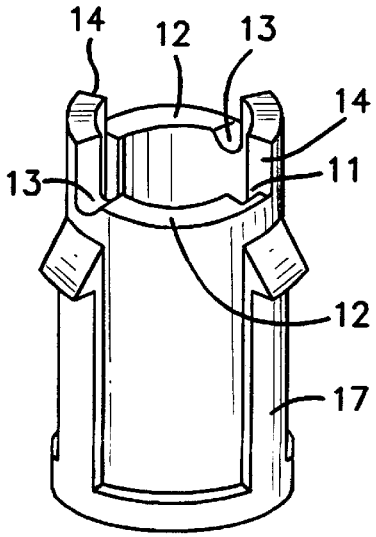
Figure 5C:
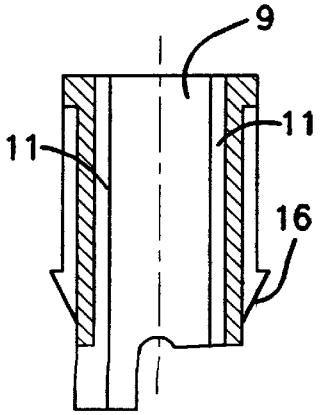
FIG. 5*c* is a sectional view taken along line A—A of FIG. 5*a;*

FIGS. 5*a*–5*c* show the female insert 5 of this embodiment, on a greatly enlarged scale. The female insert 5 comprises a central opening 10, whose inner diameter is preferably only very slightly greater than the outer diameter of shank 8 on toothbrush portion 1, to provide a close sliding fit. As best seen in FIGS. 5 and 5*c*, insert 5 also has square channels 11 formed at opposite locations within opening 10, to receive the projections 9 formed on toothbrush portion 1. Thus, toothbrush portion 1 can in this embodiment be fitted in insert 5, in one of only two angular orientations. If a unique angular orientation is desired, then it is contemplated to use only one projection 9 and channel 11, or alternatively, to position plural projections 9 and channel 11 at corresponding but irregular angular intervals.

FIG. 5*b* shows insert 5 upside down, from which it can be seen that the bottom of insert comprises opposed pairs of ramp surfaces 12 and catches 13. Thus, after toothbrush portion 1 is inserted downwardly into handle portion 2, by projections 9 sliding through channels 11, the projections 9 emerge from channels 11. At this time, the wider main shank of toothbrush portion 1 preferably rests on top of the insert 5, as the wider main shank is wider than opening 10. Thereafter, the toothbrush portion 1 is twisted to cause projections 9 to ride along the ramps 12. Rotation is possible in only one direction, owing to the presence of axial shoulders 14 which serve to block rotation in the incorrect opposite direction. The axial inclination of ramps 12, coacting with the base 15 of main shank (see FIGS. 4*a*–4*c*) contacting the top of insert 5, causes the rotation of the toothbrush portion relative to insert 5 to meet with increasing resistance, until the projections 9 snap into the catches 13. This mechanism therefore not only allows precise angular orientation of the toothbrush portion 1 relative to handle 2, but also permits a child to easily determine when the toothbrush portion is fully and correctly fastened to the handle.

Figure 6:
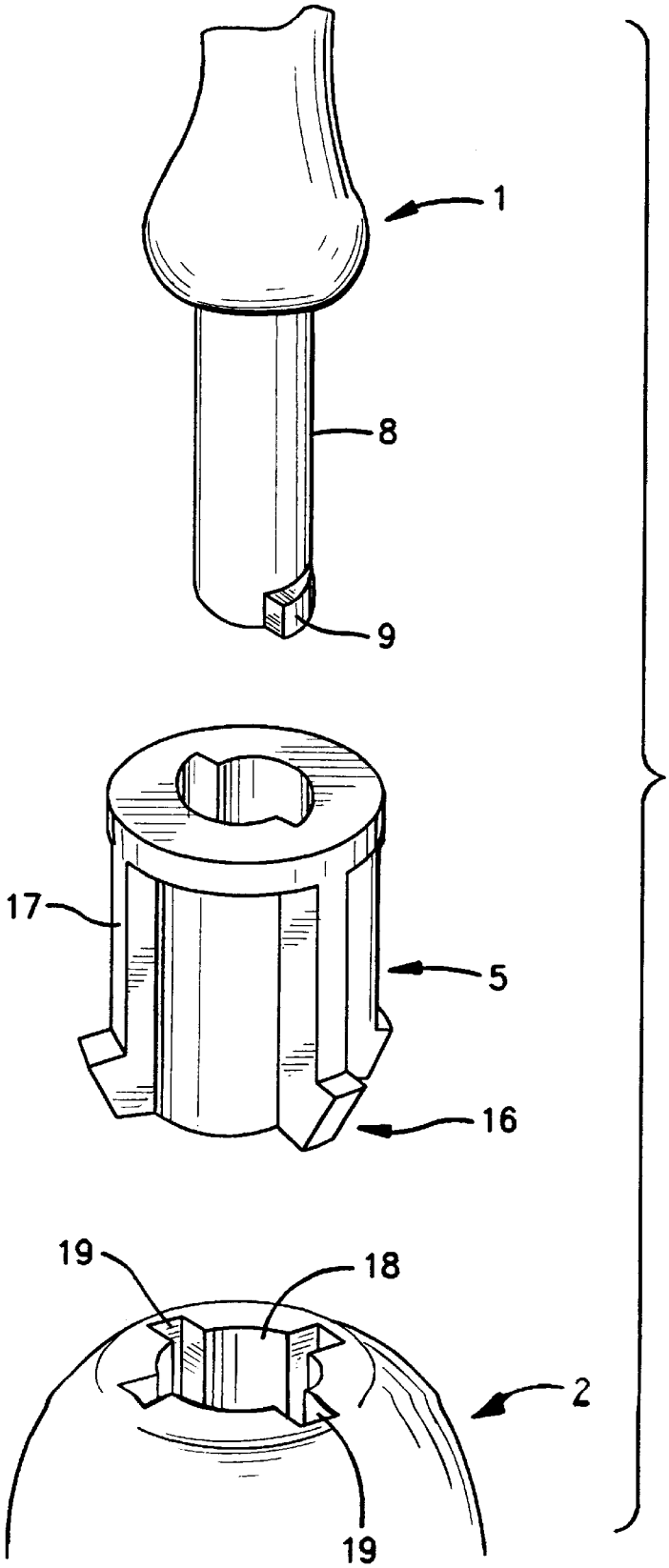
FIG. 6 is a fragmentary exploded perspective view showing the locking mechanism that secures the toothbrush proper to the handle portion, according to an embodiment of the invention.

Cleats 16 serve to retain insert in the character handle 2, as illustrated in FIG. 6. In particular, insert 5 will be fitted into an opening 18 molded preferably in the head of character handle 2. Cleats 16 of insert 5 are formed preferably integrally with axial ribs 17. Ribs 17 and cleats 16 will travel axial along square-shaped channels 19 formed with opening 18. In particular, the cleats 16 will bear against channels 19 and deform then slightly radially outwardly, owing to the inherent resiliency of the material from which handle 2 is molded. The depth of channel 19 approximately equals the length of ribs 17, so that when the cleats 16 emerge downwardly from channels 19, the cleats will pop into place, preventing subsequent removal of insert 5 from handle 2. Moreover, the positioning of ribs 17 captive within channels 19 prevents any relative rotation between insert 5 and handle 2.

Figure 7A:
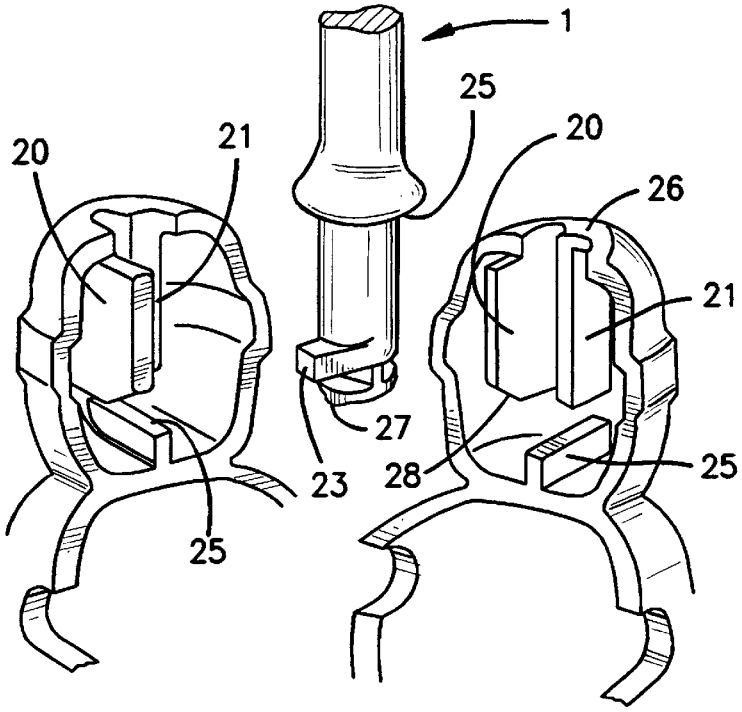
FIG. 7*a* is a partial perspective view showing an alternative locking mechanism for attaching the toothbrush proper to the handle portion.
Figure 7B:
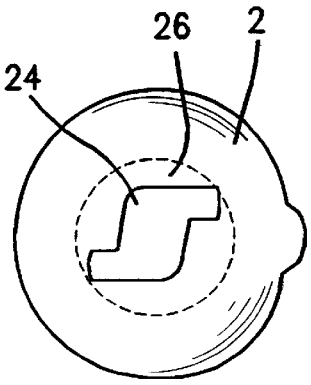
FIG. 7*b* is a top view of the handle portion in the embodiment of FIG. 7*a;*
Figure 7C:
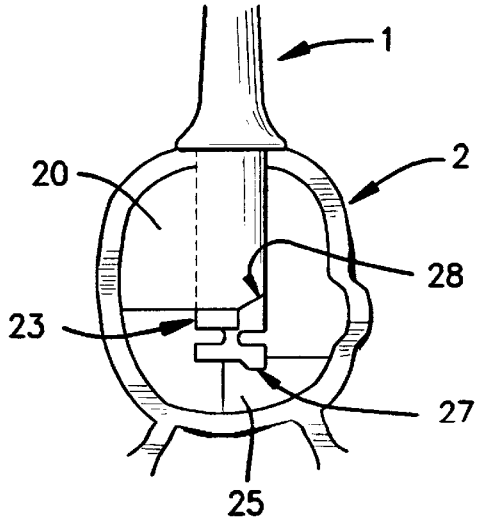
FIG. 7*c* is a fragmentary sectional view of the assembled toothbrush according to the embodiment of FIG. 7*a*.

Lastly, FIGS. 7*a*–7*d* show an alternative embodiment of the invention, in which the separate female insert 5 of the previous embodiments is dispensed with, in favor of a female coupling part which is integrally molded with the handle portion 2. FIG. 7*a* shows the handle portion cut in half. In this case, there is no plane of symmetry for the interior structure of the handle head, because the opposed parts of the female coupling structure are superimposable, as opposed to being mirror images.

Figure 7D:
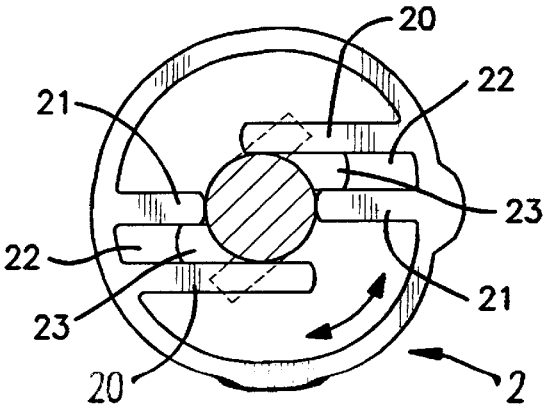
FIG. 7*d* is a schematic radial sectional view that illustrates the locking of the toothbrush proper to the handle portion, in the embodiment of FIG. 7*a*.

In FIG. 7*a*, it can be seen that each half of the handle has a wider rib 20 and a narrower rib 21. As shown in FIG. 7*d*, in the intact handle 2 these ribs 20, 21 define a pair of parallel channels 22 which receive the projections 23 formed on toothbrush portion 1.

To connect the toothbrush portion to the handle in this embodiment, the male coupling component of toothbrush portion 1 is first introduced into the correspondingly shaped opening 24 molded in handle 2. In this state, projections 23 occupy grooves 22, as shown in solid line in FIG. 7*d*. When the toothbrush portion is fully inserted into the handle, that is, when base 25 of the main shank abuts against the top 26 of opening 24, the projections 23 will be just clear of the upper edges of inclined surface 28 formed on ribs 20, but not clear of the lowermost axial edges of ribs 21. Thus, rotation of the toothbrush portion relative to the handle is possible in only one direction, as in the preceding embodiments.

The toothbrush portion is then rotated relative to the handle, to the phantom line position shown in FIG. 7*d* and beyond. As the toothbrush portion rotates relative to the handle, projections 23 ride downward along inclined portion 28, and as base portion 25 is already contacting surface 26, the resistance to rotation gradually increases. When the toothbrush is further rotated, projection 27 formed on the bottom of the male connector portion will ride over the radial rib 25 formed integrally with the handle, to a final position as illustrated schematically in FIG. 7*c*. The toothbrush portion thus snaps into place in this illustrated final position, thereby giving a tactile indication that the toothbrush portion is fully and correctly inserted in the handle.

The drawings show only one example of a character handle, but it will be appreciated that the present invention allows the toothbrush to be interchanged with different character handles, thereby to allow children the increased play value of regularly changing the appearance of their toothbrush. Conversely, the character handles according to the inventors will likely have a significantly longer useful life that the toothbrush portion, and therefore a worn out toothbrush portion can be replaced without incurring the expense of replacing the character handle as well.

Although the present invention has been described in connection with several preferred embodiments thereof, it will be appreciated that these embodiments are not to be construed in a limiting sense. Those skilled in the art will readily appreciate various modifications and substitutions of equivalent features and techniques without departing from the true scope and spirit of the appended claims.

I claim:

1. A bendable and posable toothbrush toy comprising a toothbrush portion having a longitudinal axis and being detachably secured to a handle portion, said handle portion being formed at least in part from a resilient material and having portions that are posable relative to remaining portions of said handle portion and said toothbrush portion in at least a plane perpendicular to said longitudinal axis, to assume a variety of changeable configurations of said toothbrush, wherein said handle portion is in the form of an animate character having limbs extending at an angle relative to said longitudinal axis, said limbs being posable relative to said remaining portions, and wherein said toothbrush portion is secured to said handle portion by a twist-and-lock connection comprising a male connection formed integrally with said toothbrush portion and having at least one radially outwardly extending projection, and a cylindrical socket disposed in said handle portion having at least one axial groove for receiving said at least one projection, said at least one axial groove communicating with an inclined surface defined by a cut-out portion of said cylindrical socket and cooperating with said at least one projection to releasably secure said toothbrush portion to said handle portion, said cylindrical socket further comprising at least one axial abutment restricting said toothbrush portion to rotation in only one direction upon being inserted into said cylindrical socket.

2. The toothbrush toy according to claim 1, wherein said animate character is bipedal and standing erect and having a head, said toothbrush portion being mounted in the head of said character.

3. The toothbrush toy according to claim 1, wherein said handle portion comprises at least one internal metal wire substantially coextensive with said outwardly-extending limbs, to confer said posability.

4. The toothbrush toy according to claim 1, wherein said cylindrical socket is an insert formed separately from said handle portion and mounted therein, said insert being formed of a relatively more rigid plastic material than said handle portion.

5. The toothbrush toy according to claim 1, wherein said male connection comprises a shank having an outer diameter less than a width of a main shank portion of said toothbrush portion, and wherein said cylindrical socket comprises an opening having an inner diameter greater than the diameter of said male connection shank but less than the width of said main shank portion.

* * * * *